United States Patent [19]

Nose et al.

[11] 3,989,459

[45] Nov. 2, 1976

[54] METHOD OF PREVENTING CORROSION OF STEELWORKS

[75] Inventors: Yoshiharu Nose, Kawasaki; Toshiyuki Fukushima, Yokohama; Yukio Matsuzaki, Fujisawa; Hiroshi Uemura, Machida, all of Japan

[73] Assignee: Nippon Oil Company Ltd., Tokyo, Japan

[22] Filed: Apr. 2, 1975

[21] Appl. No.: 564,457

Related U.S. Application Data

[63] Continuation-in-part of Ser. No. 274,476, July 24, 1972, abandoned, which is a continuation-in-part of Ser. No. 72,852, Sept. 16, 1970, abandoned.

[30] Foreign Application Priority Data

Sept. 24, 1969 Japan ..... 44-76127

[52] U.S. Cl. ..... 21/2.7 R; 203/7; 208/47

[51] Int. Cl.[2] ..... C23F 11/08; C23F 11/18

[58] Field of Search ..... 21/2.7 R; 203/7; 208/47

[56] References Cited

UNITED STATES PATENTS

| | | | |
|---|---|---|---|
| 2,780,583 | 2/1957 | Skei et al. | 208/47 |
| 2,947,686 | 8/1960 | Phillips | 203/7 UX |
| 2,973,316 | 2/1961 | Howland | 208/47 X |
| 3,272,736 | 9/1966 | Petro et al. | 208/47 X |

FOREIGN PATENTS OR APPLICATIONS

| | | | |
|---|---|---|---|
| 1,133,059 | 7/1962 | Germany | 208/47 |

*Primary Examiner*—Barry S. Richman
*Attorney, Agent, or Firm*—Ostrolenk, Faber, Gerb & Soffen

[57] ABSTRACT

A method of preventing corrosion of steelworks by a flowing corrosive solution having a pH of 6.7 to 7.1 and comprising water, ammonia in a concentration of from 0.5 to 4 mols per liter of solution and hydrogen sulfide in a concentration of from 5 to 15 kg/cm$^2$ as its partial pressure in the vapor phase, said corrosive solution contacting said steelwork at a flow velocity of from 1 to 10 meters per second by adding at least one substance selected from the group consisting of elemental sulfur, ammonium polysulfide and alkali polysulfide to said corrosive solution in an amount of 74–200 ppm as the amount of available sulfur.

5 Claims, 2 Drawing Figures

METHOD OF PREVENTING CORROSION OF STEELWORKS

This is a continuation-in-part of application Ser. No. 274,476 filed July 24, 1972, which is a continuation-in-part of application Ser. No. 72,852, filed Sept. 16, 1970, both now abandoned.

The present invention relates to a method of preventing steelwork from corrosion by a corrosive fluid containing at least water, ammonia and hydrogen sulfide, and in particular, containing a high concentration of ammonia and hydrogen sulfide, which is discharged during the process of hydrodesulfurization of heavy petroleum products.

As a process to remove sulfur components from heavy petroleum fuels containing the same, hydrodesulfurization has flourished remarkably in recent years. The process, however, is one of catalytic hydrodesulfurization, wherein a sulfur containing raw material oil is generally caused to react with hydrogen at a high temperature and pressure in the presence of a hydrogenating catalyst. Thus the sulfur component in the raw material oil is sent forth in the form of hydrogen sulfide. Ammonia is produced as a by-product in a small quantity when a relatively lighter oil undergoes hydrodesulfurization, but is formed in a considerable amount when a comparatively heavier oil is processed. In a vapor, the hydrogen sulfide and ammonia remain unreacted with each other at a high temperature, but they deposit as ammonium hydrosulfide at a relatively lower temperature to clog various apparatuses, for example, heat exchangers, down stream. Accordingly, in order to prevent apparatus from clogging, the ammonium hydrosulfide formed is generally melted and removed by injecting water.

Such a fluid containing hydrogen sulfide, ammonia and water is, however, very corrosive. Particularly, the fluid mentioned above contains hydrogen sulfide and ammonia in a very high concentration, and flows at a high velocity. Accordingly, heavy corrosion occurs in the steelwork leading the fluid. Piehl et al. reported, at the 33rd Midyear Meeting of API's Division of Refining (May 15, 1968), that such a fluid is highly corrosive, and that the high concentration of hydrogen sulfide and ammonia and a large flow velocity of the fluid bring about fluid corrosion of steel materials.

Figure 1:
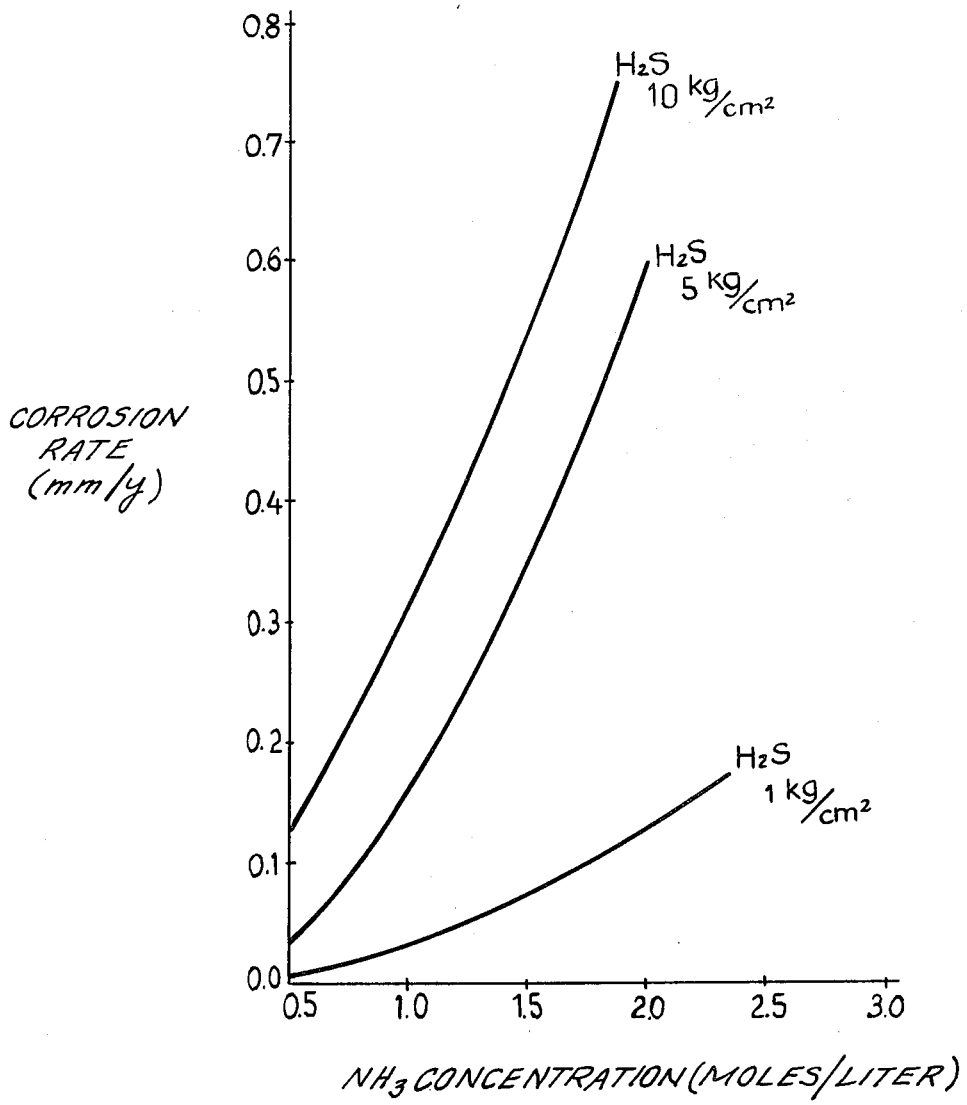

In FIG. 1, the corrosion rate of an aqueous solution containing ammonia and hydrogen sulfide in the present invention is shown. It represents a relationship between the concentration of ammonia and pressure of hydrogen sulfide affecting the corrosion of iron. The corrosion rate (mm/y) is plotted along the axis of ordinates and the concentration of ammonia in water (mol/lit. solution), the axis of abscissas. The rate was taken in accordance with the method described in Example 1. FIG. 1 shows that when the concentration of ammonia is more than 0.5 mol/liter and the hydrogen sulfide partial pressure is more than 5 kg/cm$^2$, the increase of their concentration is accompanied with a rapid growth of corrosion. Therefore, it can safely be said that this corrosive system is distinctly different from the corrosive solution disclosed by Skei et al. with respect to the fact of lowering the corrosion rate by adding ammonia thereto as a neutralizing agent.

There has not been found any useful means to prohibit corrosion of steelwork resulting from such a corrosive fluid heretofore.

The present invention is concerned with a method of anticorrosion of steelwork against a corrosive fluid which contains at least water, ammonia and hydrogen sulfide, the concentration of ammonia being 0.5 to 4 mol/lit. of solution, the concentration of hydrogen sulfide 5 to 15 kg/cm$^2$ as its partial pressure in vapor phase, having pH 6.7 – 7.4 and the flow velocity of the fluid being 1 to 10 m/sec. More particularly, it relates to a method to prevent corrosion of steel materials by adding 5 ppm to 0.3 wt% as the amount of available sulfur of at least one substance selected from the group consisting of elemental sulfur, ammonium polysulfide and alkali polysulfides to the fluid.

The corrosive fluid in the present invention means, for example, a mixture of water and gaseous substances containing hydrogen sulfide and ammonia which is discharged in such a process as to cause hydrogen to react with heavy petroleum fractions containing more than 50% of fractions having a boiling point above that of gas oil at 300° – 500° C in the presence of a catalyst, wherein the said catalyst contains a metal of VI and/or VIII group in the periodic Table, for example, Ni, Fe, Co, Pd, Pt, W, Mo, etc. as a metal component and the metal component is supported on a porous material such as alumina or silica alumina and others.

It has been known heretofore, as T. Skei et al. disclosed in U.S. Pat. No. 2,780,583, that in order to attain anticorrosion against an acidic aqueous solution containing hydrogen sulfide, the aqueous hydrogen sulfide solution is neutralized by adding ammonia thereto to a pH 7.8 – 8.3 followed by adding inorganic polysulfides or by adding elemental sulfur and oxygen so as to form polysulfides in the system.

The disclosure of Skei et al., however, is clearly concerned with anticorrosion against an aqueous solution containing hydrogen sulfide. Accordingly ammonia is used as a neutralizing agent for anticorrosion, and the concentration of hydrogen sulfide is considerably low and is in the degree of one atm at best represented as its partial pressure in vapor phase.

When the concentration of hydrogen sulfide is about one atm. as its partial pressure in vapor phase, it is true that corrosive action is decreased compared with that of the original hydrogen sulfide solution by adding ammonia to a pH 7.8 – 8.3 and further adding polysulfides, as is disclosed by T. Skei et al. However, Skei et al merely disclose that a corrosive solution the hydrogen sulfide concentration of which is about one atm. and the pH of which is adjusted to 7.8 – 8.3 by the addition of ammonia becomes non-corrosive by the addition of polysulfides further (see claim 1 and FIG. IV of Skei et al.).

On the other hand, in case hydrogen sulfide concentration is about one atm. as shown in Skei et al. and the pH is 7 or so or below 7, it is disclosed that corrosive action becomes more severe by the addition of polysulfides, compared with the case in which polysulfides are not added (see FIG. IV of Skei et al.). In other words, Skei et al disclose that when the pH is 7 or so or below 7, the addition of polysulfides is rather detrimental.

In contrast with this, when the hydrogen sulfide concentration is as high as 5 to 15 atm. and the ammonia concentration is 0.5 to 4 mol/lit. of solution, the higher the ammonia concentration, the more severe becomes the corrosion. It is five to ten times more severe than in the case where the hydrogen sulfide partial pressure is, for example, one atm. or so, as shown in FIG. 1 of Skei et al. The addition of ammonia to such as system is harmful. Thus, the corrosive solution of by T. Skei et al. is quite different from that of the present invention, and moreover, the solution in the present invention is in fluid state at such a high velocity as 1 to 10 m/sec.

It has not been disclosed heretofore that effective anticorrosion can be carried out by adding a prescribed amount of ammonia, ammonium polysulfide and alkali polysulfides to such a corrosive system as above. This fact has been found only after a number of experiments have been conducted by the inventors.

The present invention is characterized in that at least one substance selected from the group consisting of elemental sulfur, ammonium polysulfide and alkali polysulfides is added in an amount of 5 ppm to 0.3 wt% as the amount of available sulfur to inhibit corrosion resulting from a corrosive solution containing at least water, ammonia and hydrogen sulfide, wherein the ammonia concentration is 0.5 to 4 mol/lit. of pH 6.7 to 7.4 solution, the hydrogen sulfide concentration being 5 to 15 kg/cm$^2$ as its partial pressure in vapor phase, and the flow velocity of the solution being 1 to 10 m/sec.

The anticorrosive effect is very low when the amount of added substances is below the prescribed amount, but it is not desirable from the commercial point of view to add them over the predetermined quantity, even if there is no harm. It is preferable to use these substances in the form of an aqueous solution or a suspension.

The term "amount of available sulfur" in the present invention represents the weight of elemental sulfur or in the case of ammonium polysulfide $[(NH_3)_2Sn]$ and alkali polysulfides ($Me_2Sn$; Me is an alkali metal), it is calculated in accordance with the following formula:

$$A = B \times \frac{32(n-1)}{Mw},$$

where

A: Amount of available sulfur

B: Weight of polysulfide

Mw: Average mol. wt. of polysulfide

*n:* Number of sulfur atoms in the polysulfide molecule.

In the present invention, the amount of available sulfur added is in the range of from 5 ppm to 0.3 wt%. When the hydrogen sulfide concentration is constant, it is preferable to increase the amount of available sulfur to be added in compliance with the ammonia concentration. For example, when the concentration of hydrogen sulfide is 10 kg/cm$^2$, the amount of available sulfur A is preferably added in the range as calculated by the following formula:

$$\log A \geqq k \log a + C,$$

where

A: Amount of available sulfur added (ppm)

K: Constant depending on hydrogen sulfide concentration, assumed to be 1.8 in this case

*a:* Concentration of ammonia (mol/lit. of solution)

C: Constant, assumed to be 2.2 in this case.

It is not known well why anticorrosion is attained effectively by a method according to the present invention. It is observed, however, that there is formed a solid passive state consisting of complex sulfides of iron, even at a high flow velocity of the fluid. Accordingly, one may attribute the anticorrosion of steelwork to the fact above.

The following examples will be shown in order to illustrate more fully the present invention.

EXAMPLE 1

A corrosion test was effected using test pieces (JIS G-3310, No. 600 emery polished, 5 × 1.5 cm) made of a low carbon steel as an agitator in a corrosive liquid, consisting of 50 ml of 3.5 N aqueous ammonia solution and 50 ml of gas oil, and added with various kinds of corrosion inhibitors, in hydrogen sulfide deaerated by nitrogen at a pressure of 5.2 kg/cm$^2$ (gauge pressure). The agitator made of the test piece was rotated at 1,900 r.p.m. at 60° C for 4 days. The fluidity corresponds to that of a time when said liquid is passed through a pipe of 1 inch in diameter at a flow velocity of 3 m/sec. The result of the test is shown in Table 1.

Table 1

| Test No. | Corrosion inhibitor | Result of agitating corrosion test: Quantity added (ppm) | Corrosion rate (mm/y) | Anticorrosion rate (%) | pH |
|---|---|---|---|---|---|
| 1 | No. corrosion inhibitor is added | — | 0.61 | 0 | 7.1 |
| 2 | S | 110 | 0.00 | 100 | 7.1 |
| 3 | Sodium polysulfide | 200(90)* | 0.00 | 100 | 7.1 |
| 4 | Ammonium polysulfide | 190(74)* | 0.00 | 100 | 7.1 |
| 5 | Corrosion inhibitor on the market, E** | 500 | 0.32 | 50 | 7.1 |

*The amount of available sulfur is shown in the parethesis

**Dodigen 214 (manufactured by Farbwerke Hoechst A.G.) The corrosion inhibitor used in the present invention showed a perfect anticorrosive property also in the agitating corrosion test.

***pH of the corrosive solution before the addition of corrosion inhibitors.

EXAMPLE 2

Figure 2:
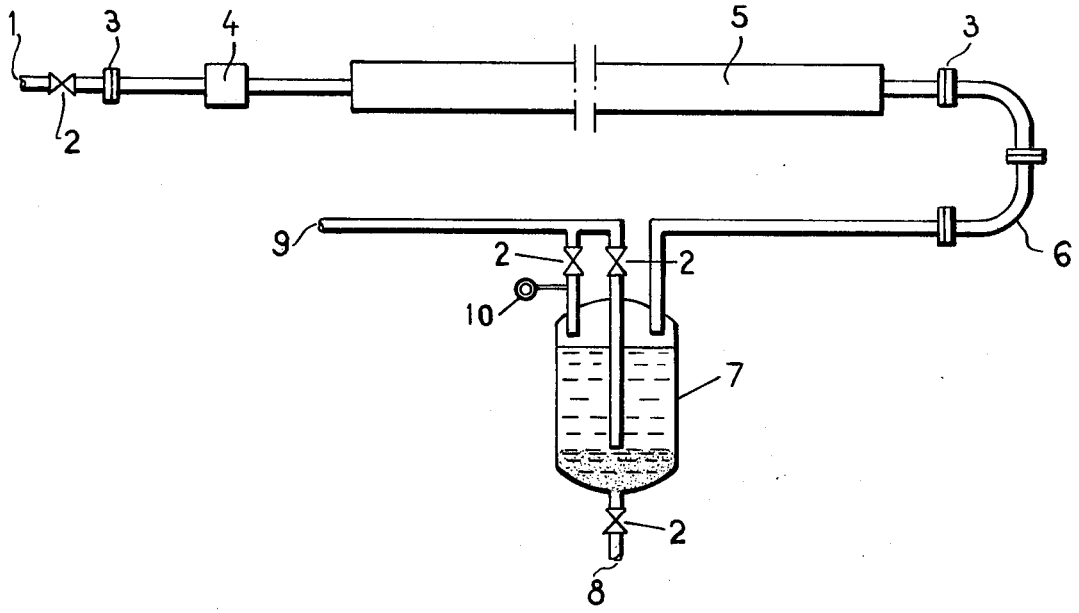

A fluid corrosion test was conducted by using a testing apparatus shown in FIG. 2. In FIG. 2, the numerals numbered represent the following:

| | |
|---|---|
| 1 | Inlet of fluid |
| 2 | Valve |
| 3 | Flange |
| 4 | Injection opening of water and corrosion inhibitor |
| 5 | water-cooled cooler |
| 6 | Elbow for corrosion test (low carbon steel, 25.4 mm in inner dia., 5 mm thick) |
| 7 | Vapor-liquid separator |
| 8 | Waste water drain |
| 9 | Outlet of fluid |
| 10 | Pressure gauge |

A part of effluent from a hydrodesulfurization reactor was introduced into the testing apparatus through an inlet 1, and water and a corrosion inhibitor were injected into the effluent through an injection opening 4. The mixture of the effluent, water and corrosion inhibitor was cooled to below 60° C in a cooler 5 to be transferred through an elbow 6. Subequently the cooled mixture fluid was led to a separator 7 and was separated into three layers comprising a vapor state product containing unreacted hydrogen and hydrogen sulfide, a liquid product and a water containing dissolved hydrogen sulfide and ammonia. Then, the respective layer thus separated was discharged out of the apparatus through an outlet 9 and a drain 8. The corrosion test was performed continuously for 20 days under the same conditions. After the completion of running, the elbow 6 was removed and cut to measure the change of thickness at the corroded part maximum and calculate its corrosion rate (mm/y). The partial pressure of hydrogen sulfide in the apparatus was calculated from the total pressure of a pressure gauge 10 and the hydrogen sulfide concentration in the vapor. The ammonia concentration in the corrosive fluid was obtained from analyzing a sampled water at the waste water drain 8. The flow velocity of the corrosive fluid was calculated from the inner diameter of the elbow and the flow quantity of the liquid fluid.

The result of the corrosion test is summerized in Table 2. In this test, the conditions of corrosive action seems to be varied at all times because a complex fluid including a vapor, liquid hydrocarbons and water streams through the elbow at a high flow velocity. In fact, the difference in the corrosion rate in cases where a corrosion inhibitor is added and where it is not used is large. In spite of it, the corrosion inhibitor according the present invention, however, has a superior anticorrosive character, as is seen in Table 2. In contrast with this, an anticorrosive on the market hardly showed corrosion preventive property under such far severer corrosive conditions as in this test, although in Example 1 it had anticorrosive property in some degree. When no corrosion inhibitor is used or when no anticorrosive result is observed in spite of its being used, the corroded surface reveals a metallic body. On the contrary, according to the method of the present invention, a black and thickly coated film is formed on the metal surface. It seems that there is formed a film in the form of a solid passive state and that the film prevents the metal surface from contact with the corossive fluid in a violent fluidity.

Table 2

| Corrosion inhibitor | Quantity added (ppm) | Result of fluid corrosion test: Pressure of hydrogen sulfide ($kg/cm^2$) | Concentration of ammonia (mol/lit. of solution) | Flow velocity of liquid fluid (m/sec) | Corrosion rate (mm/y) | Anti-Corrosion rate (%) | pH |
|---|---|---|---|---|---|---|---|
| nil | — | 8.8 | 1.3 | 5 | 8.4 | — | 6.8 |
| nil | — | 9.2 | max.1.2 | 5 | 6.0 | — | 6.6 |
| nil | — | 7.0 | min.1.5 | 5 | 7.8 | — | 7.0 |
| Mean value | — | — | — | — | 7.4 | 0 | — |
| Elementary sulfur | 200* | 8.3 | 1.4 | 5 | 1.4 | 81 | 6.9 |
| Sodium polysulfide | 200* | 8.6 | 1.3 | 5 | 0.6 | 92 | 6.9 |
| Ammonium polysulfide | 200* | 9.0 | 1.3 | 5 | 1.0 | 86 | 6.8 |
| Commercial corrosion inhibitor E** | 500 | 8.8 | 1.3 | 5 | 7.0 | 5 | 6.8 |

*Amount of available sulfur
**Dodigen 214 (manufactured by Farbwerke Hoechst A.G.)

What is claimed is:

1. A method of preventing corrosion of steelworks by a flowing corrosive solution having a pH of 6.7 to 7.1 and comprising water, ammonia in a concentration of from 0.5 to 4 mols per liter of solution and hydrogen sulfide in a concentration of from 5 to 15 $kg/cm^2$ as its partial pressure in the vapor phase, said corrosive solution contacting said steelwork at a flow velocity of from 1 to 10 meters per second which comprises adding at least one substance selected from the group consisting of elemental sulfur, ammonium polysulfide and alkali polysulfide to said corrosive solution in an amount of 74–200 ppm as the amount of available sulfur.

2. The method of claim 1 wherein said substance is elemental sulfur.

3. The method of claim 1 wherein said substance is ammonium polysulfide.

4. The method of claim 1 wherein said substance is sodium polysulfide.

5. The method of claim 1 wherein said corrosive solution is the discharge of a process of hydrodesulfurization wherein heavy petroleum fractions containing more than 50% of fractions boiling at a temperature above the boiling point of gas oil is reacted with hydrogen at from 300°–500° C. in the presence of a catalyst containing a metal of Group VI, Group VIII or mixtures thereof, of the Periodic Table.

* * * * *